US010163427B1

(12) United States Patent
Sutherland et al.

(10) Patent No.: US 10,163,427 B1
(45) Date of Patent: Dec. 25, 2018

(54) PERCUSSION MUSICAL INSTRUMENT

(71) Applicants: James Caye Sutherland, Baton Rouge, LA (US); Luke Wacu Notary, Los Angeles, CA (US)

(72) Inventors: James Caye Sutherland, Baton Rouge, LA (US); Luke Wacu Notary, Los Angeles, CA (US)

( * ) Notice: Subject to any disclaimer, the term of this patent is extended or adjusted under 35 U.S.C. 154(b) by 0 days.

(21) Appl. No.: 15/242,009

(22) Filed: Aug. 19, 2016

Related U.S. Application Data

(60) Provisional application No. 62/206,917, filed on Aug. 19, 2015.

(51) Int. Cl.
*G10D 13/02* (2006.01)

(52) U.S. Cl.
CPC ..... *G10D 13/025* (2013.01)

(58) Field of Classification Search
CPC ..... G10D 13/025
See application file for complete search history.

(56) References Cited

U.S. PATENT DOCUMENTS 436,590 A * 9/1890 Theophel ..... G10D 13/025 84/416
478,611 A * 7/1892 Knittel ..... G10D 13/025 84/415
1,265,917 A * 5/1918 Jay ..... G10D 13/025 84/411 M
2,604,001 A * 7/1952 Lewan ..... G10D 13/025 84/417
5,986,195 A * 11/1999 Liao ..... G10D 13/06 84/402
7,435,887 B2 * 10/2008 Nickel ..... G10D 13/025 84/415
7,482,522 B2 * 1/2009 Wening ..... G10D 13/02 84/411 R
7,649,132 B2 * 1/2010 Nickel ..... G10D 13/025 84/415
8,008,560 B2 * 8/2011 Wiese ..... G10D 13/023 84/411 R
8,115,088 B2 * 2/2012 Herrera ..... G10D 13/02 84/411 R
8,481,834 B2 * 7/2013 Eduardo ..... G10D 13/02 84/411 R
9,343,050 B2 * 5/2016 Sallee ..... G10D 13/06
9,653,054 B1 * 5/2017 Belli ..... G10D 13/025
9,691,366 B2 * 6/2017 Amos ..... G10D 13/00
9,837,058 B2 * 12/2017 Trask ..... G10D 13/006
(Continued)

OTHER PUBLICATIONS

Ramsey, Steve Build your own multifunction stompbox / tambourine / cajon viewed Jan. 5, 2017 at https://www.youtube.com/watch?v=dvXNv4XXllc.*

(Continued)

*Primary Examiner* — Robert W Horn
(74) *Attorney, Agent, or Firm* — Roy Kiesel Ford Doody & Thurmon, APLC

(57) ABSTRACT

A percussion musical instrument constructed to be played by striking the instrument with one or both of a person's feet comprising a body having at least one surface area to which is affixed at least one snare mechanism bearing on the surface area in a manner to be responsive to the striking of the feet on a second surface area of the body.

6 Claims, 3 Drawing Sheets

(56) References Cited

U.S. PATENT DOCUMENTS

| | | | | |
|---|---|---|---|---|
| 2008/0034944 | A1* | 2/2008 | Aspland | G10D 13/006 84/415 |
| 2014/0041508 | A1* | 2/2014 | Trask | G10D 13/025 84/415 |
| 2015/0114206 | A1* | 4/2015 | Krol | G10D 13/025 84/417 |
| 2016/0275924 | A1* | 9/2016 | Hacker | G10D 13/025 |
| 2017/0263221 | A1* | 9/2017 | Simonek | G10D 13/025 |

OTHER PUBLICATIONS

Peterman Acoustic, Stomp Da Floor, viewed Jan. 5, 2018 at https://www.youtube.com/watch?v=wDjAr_hJAWY.*

* cited by examiner

PERCUSSION MUSICAL INSTRUMENT

PRIORITY CLAIM

This application claims benefit of and priority to U.S. Provisional Application 62/206,917, filed on Aug. 19, 2015, which is hereby incorporated by referenced in its entirety.

BACKGROUND OF THE INVENTION

Field of the Invention

This invention relates in general to musical instruments, and more particularly, to percussion musical instruments constructed to be played by striking the instrument with one or both of a person's feet.

Prior Art

The use of snares, such as in snare drums and other devices, to create buzz-like or rattling sounds or tones are known in the art. For purposes of this invention the word "snare" shall include any type of cord or similar structure that produces a buzz-like or rattling sound when used with one or more musical instruments, including snare drums, jingles, bells, shakers, beads, sessas metal rattles, cajons, guitars, bass strings, or similar instruments that are played using a striking instrument such as drum sticks or by contact or movement with a person's hands.

It is also known to use a mechanical bass drum pedal operated by a musician's foot that is positioned adjacent to or attached to a bass drum to beat the stretched drum skin or vellum. However, none of these prior art devices permit the musician while sitting or standing to use one or both feet to directly strike the percussion instrument for the purpose of playing the instrument.

OBJECTS OF THE INVENTION

It is an object of this invention to provide a percussion instrument to allow the musician to play the instrument by striking it with his feet without having to position or attached extraneous devices to the instrument and to allow his hands to remain free to play a second musical instrument.

It is an object of this invention to provide a percussion instrument that can be easily and inexpensively constructed.

These and other objects and advantages of the invention shall become apparent from the ensuing descriptions of the invention.

SUMMARY OF THE INVENTION

Accordingly, a percussion musical instrument for playing by striking a surface area of the instrument with a person's feet is provided comprising a body having a first surface area to which is affixed at least one snare in a position for the snare to bear against a second surface area of the instrument with sufficient pressure to cause the snare to vibrate and emit a buzz-like or rattling sound when the second surface area is struck by a person's foot.

More particularly, the body of the percussion instrument is be constructed to have any one of known geometric shapes which when placed on a surface will have at least one wall surface area to which the snare can be affixed and a second wall surface area that can be struck by a person's foot when the percussion instrument is being played. In a preferred embodiment the body has a cavity formed by its walls. One preferred body is formed by a top wall, at least one vertical side wall and a bottom wall affixed to one another to form an interior cavity. In this embodiment the vertical side wall preferably has a port connecting the interior cavity to the environment outside of the body. Further, in this embodiment the exterior surface area of the top wall of the body is constructed to permit a person to stand or when seated to strike the exterior surface area with one or both of his feet. The snare is affixed to the body at a position to permit the snare to bear against the interior surface area of the top wall whereby when the exterior surface area is struck by a person's foot, the snare will vibrate to produce a buzz-like or rattle sound. In a more preferred embodiment, the body further comprises leg members to position the bottom wall off of the surface that the instrument is placed to provide better sound production of the buzz-like or rattling sound produced by the snares and to prevent damage to the bottom wall when the top wall is being struck by a person's foot.

In a further preferred embodiment the body comprises an elongated member rotationally affixed to the body, preferably to opposing surfaces of the side wall. Affixed to the elongated member are one or more snares in a position to cause the snares to bear against and apply more or less pressure against the interior top wall surface when the elongated body is rotated clockwise or counterclockwise, respectively. The elongated member comprises one of any known conventional locking mechanisms that will prevent further rotation of the elongated body once the desired bearing pressure has been achieved.

The foregoing has outlined rather broadly the features and technical advantages of the present invention in order that the detailed description of the invention that follows may be understood. Additional features and advantages of the invention will be described hereinafter which form the subject of the claims of the invention. It should be appreciated by those skilled in the art that the conception and specific embodiments disclosed may be readily utilized as a basis for modifying or designing other structures for carrying out the same purposes of the present invention and do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The accompanying figures illustrates preferred embodiments of this invention. However, it is to be understood that these embodiments is not intended to be exhaustive, nor limiting of the invention. They are but examples of the construction of this invention.

PREFERRED EMBODIMENTS OF THE INVENTION

Without any intent to limit the scope of this invention, reference is made to the figures in describing the preferred embodiments of the invention.

Figure 1:
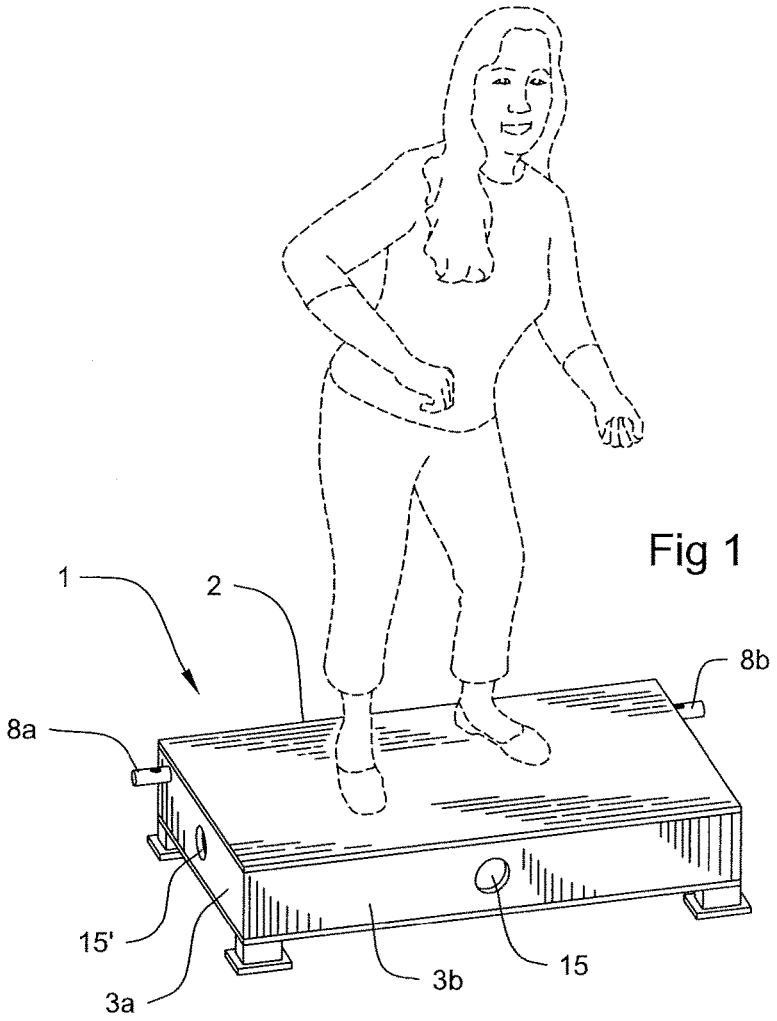
FIG. 1 is a three-quarter perspective view of a person standing on the percussion musical instrument to begin playing the instrument by striking the top wall with his feet.

Unlike other instruments, and as illustrated in FIG. 1, body 1 is designed to bear the full weight of a person applying extreme impact with their body through their feet to play the instrument. Referring to FIGS. 2-5, the body 1 includes a top wall 2, multiple vertical side walls 3*a*, 3*b*, 3*c*, and 3*d*, and a bottom wall 4 forming a cavity 5. In a preferred embodiment there is a thin rubber gasket or other known sealant glued in position between each joint formed by the side walls, as well as the top and bottom edges formed by the top wall and side walls, and the bottom wall and the side walls to obtain an air tight seal. Within cavity 5 are positioned snares 6 affixed to an elongated slat member 7 having opposed end members 7*a* and 7*b* sized and shaped to extend into tubular members 8*a* and 8*b* extending perpendicularly from side walls 3*a* and 3*c*, respectively, to permit elongated slat member 7 to rotate in tubular members 8*a* and 8*b* to position snares 6 to bear against the interior surface 9 of top wall 2, preferably below on the interior surface 9 where the top surface 2 is being struck by the feet, generally in the center area of the interior surface 9. In a preferred embodiment tubular member 8*a* is provided with a conventional stop member 10 to fix opposed end members 7*a*, 7*b* in a desired fixed position within tubular members 8*a*, 8*b*, respectively. One example of a conventional stop member 10 is are screws 10*a* and 10*b* that can be screwed into threaded opening 11*a* and 11*b* of tubular member 8*a* to contact and hold end members 7*a* and 7*b* in the desired fixed position.

Figure 3:
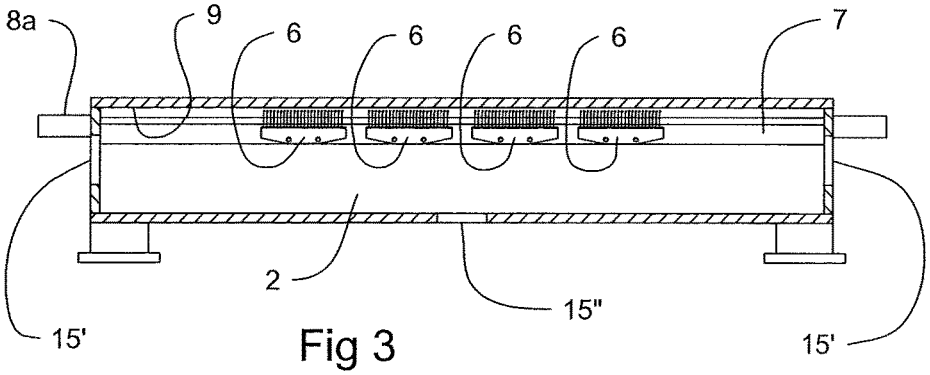
FIG. 3 is a cross-sectional view taken along lines I-I of FIG. 2 illustrating the attachment of the snares to an elongated member positioned to cause the snares to bear against the interior surface of the top wall of the body.
Figure 2:
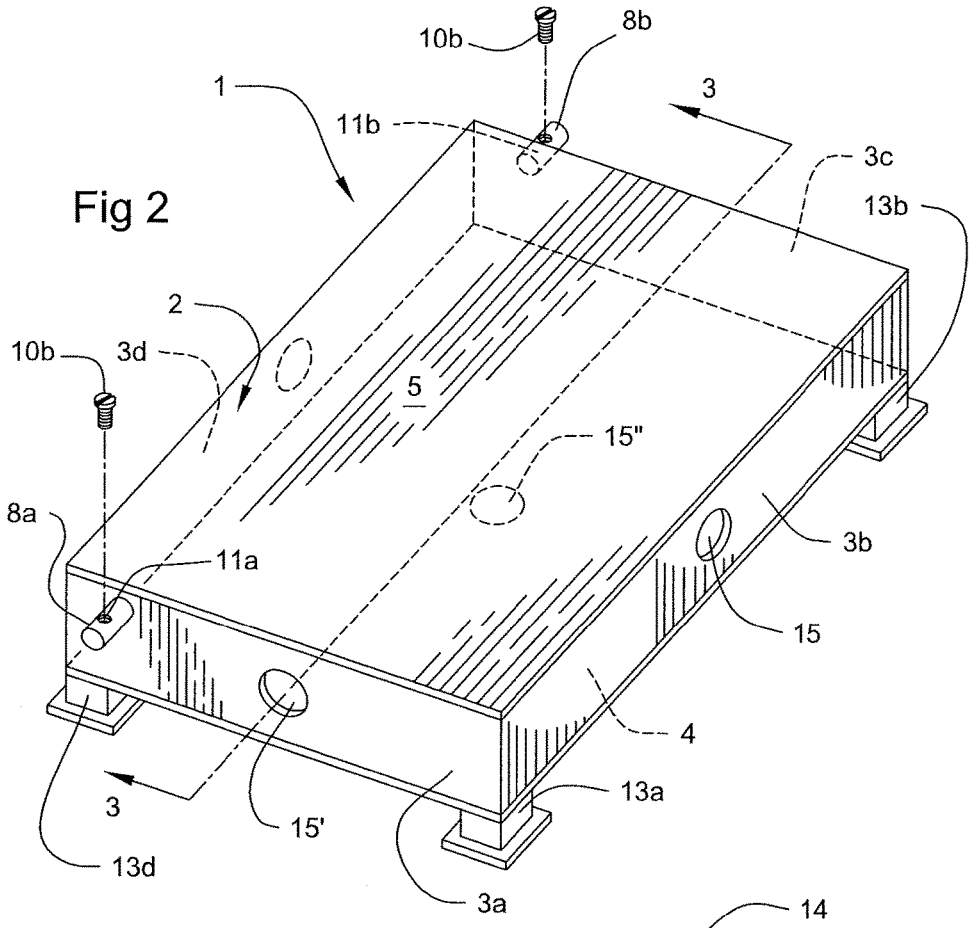
FIG. 2 is a three-quarter perspective view of a generally rectangular box shaped percussion musical instrument of this invention having a cavity to contain the snares and having a port to permit sound produced by the snares to exit the cavity into the environment outside the instrument body.
Figure 4:
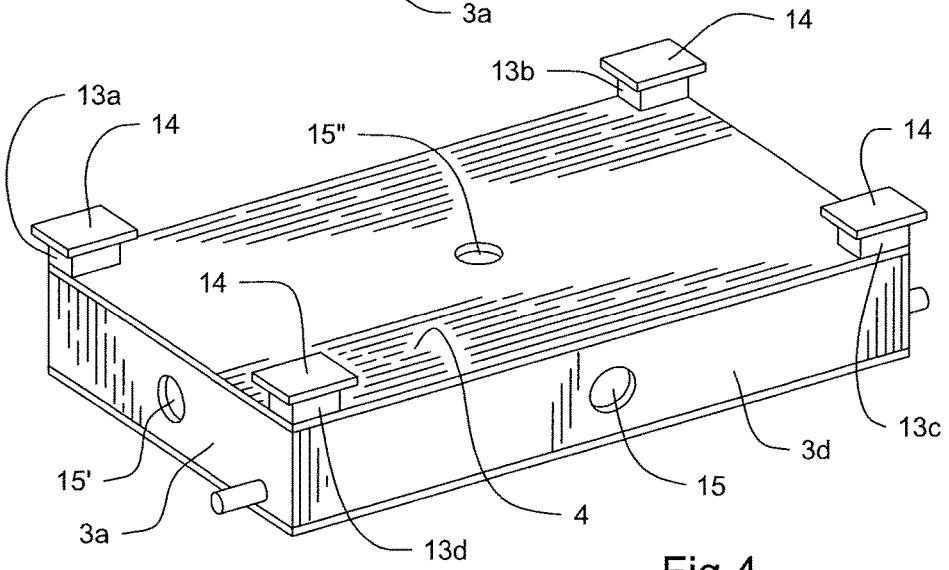
FIG. 4 is a three-quarter perspective bottom view of a preferred embodiment of this invention illustrating leg members for supporting the bottom wall of the instrument off of the ground surface.

In a further preferred embodiment, as seen in FIG. 3, there is attached to the exterior surface 12 of bottom wall a series of leg member 13*a*, 13*b*, 13*c* and 13*d* extending from the corner sections of bottom wall 4 to position the body 1 off of the surface that the instrument will be placed during use. In a preferred embodiment rubber pads 14 affixed to legs 13*a*-13*d* are attached to each corner area of bottom wall 4 to lift instrument body 1 from about 0.25 inches-0.75 inches off of the ground to provide better sound production and to prevent damage to the bottom wall 4 while playing the instrument.

With the joints sealed a port 15 is created in at least one of the walls to significantly increase the bass tone escaping from the cavity 5 to the outside environment. If the snares 6 are positioned to strike the interior surface 9 of top wall 2, it is preferred that port 15 be constructed in the central section of elongated side wall 3*b* or 3*d* to provide a more stable, sturdier instrument 1 when being played. Alternatively, one of the shorter side walls, preferably side wall 3*a* and 3*c*, can be constructed having a port 15' connecting cavity 5 with the listening environment surrounding body 1. It is preferred that port 15 be positioned in the middle area of bottom wall 4. In another alternate embodiments port 15" can be constructed in the bottom wall 4. Port 15 is sized and shaped to create the desired resonance of the sound created in cavity 5 by the snares 6. The port 15 is preferably circular in shape having an approximately 4 inch-5 inch diameter. Depending on the size and shape of cavity 5, the size of the port 15 and the number of ports 15 can be varied if desired.

To have the desired structural stability and strength to permit a person to stand on and to strike the body 1 with his/her feet, it is preferred that the body 1 be constructed of wood wherein its bottom wall 4 has an approximate 0.5 inch-1 inch thickness, more preferably about 0.75 inch thickness. It is also preferred that top wall 2 and the side walls 3*a*-3*d* each have an approximate 0.25 inch-0.75 inch thickness, more preferably about 0.5 inch thickness. To provide space for the movement of the feet during the operation of the instrument it is further preferred that the top wall 2 have a surface area of sufficient size to permit the feet of the person playing the percussion instrument be positioned on the exterior surface area 16 of the top wall 2 while playing the instrument. A 23 inch width by 36 inch length surface area 16 is preferred for most persons. The size of surface area 16 can be varied depending on the size of the person and whether the person will stand on the exterior surface area 16 of the top wall 2 while playing the instrument. It is further preferred that the vertical side walls 3*a*-3*d* have a height of approximately 10 inches to produce a desired quality sound within the interior cavity 5. It has also been found that a quality sound is produced when the wood is maple for the top wall 2 and popular for the side walls 3*a*-3*d* and bottom wall 4. Other woods that can be used include cherry, oak, rose, and birch depending on the sound quality and stability desired.

Figure 5:
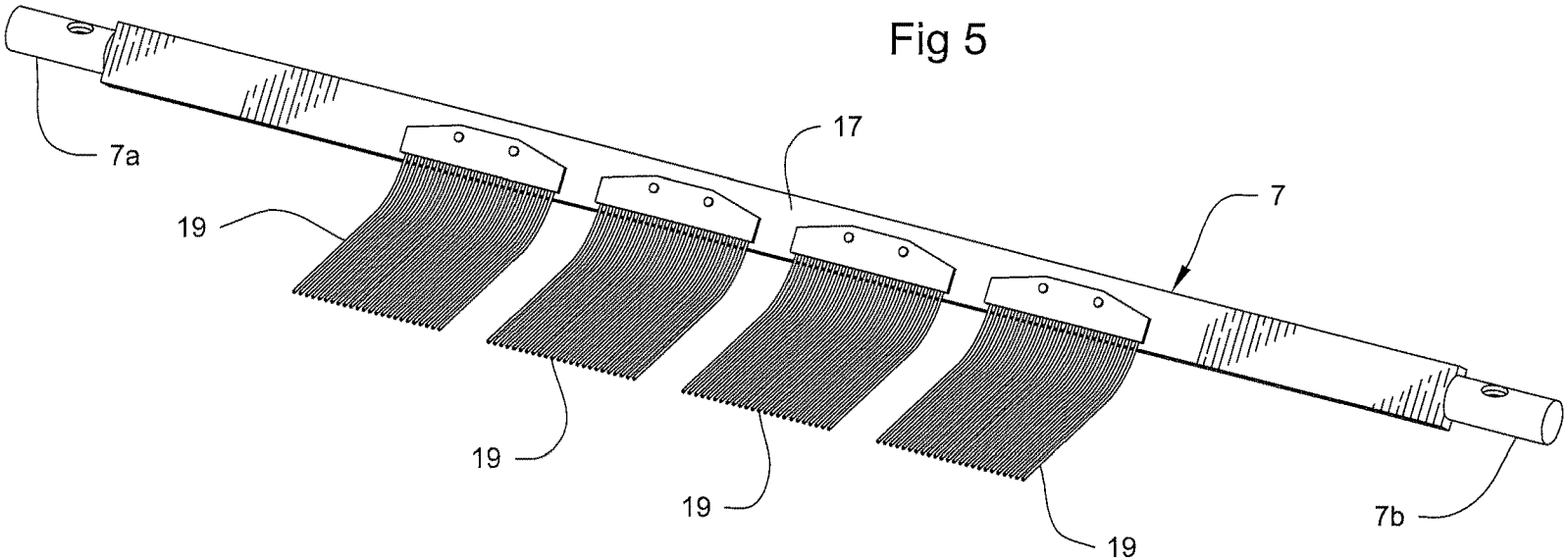
FIG. 5 is a frontal view of the elongated member including the screw stop member to prevent rotation of the elongated member when the snares have been brought to bear against the interior surface of the top wall.

Referring to FIG. 5, it is preferred that the snare 6 be a snare used with a conventional snare drum. Still further, it is preferred that elongated member 7 have a middle slat shaped section 17 to which snares 6 are affixed by screws 11 or other conventional attaching devices. Extending from opposing ends of middle section 17 are circular cross-section members 7*a* and 7*b* sized to fit and rotate about the central axis of opposing hollow tubular members 8*a* and 8*b*, respectively, extending from opposite side wall 3*a*, 3*c*. One or both of tubular members 8*a*, 8*b* are provided with threaded opening 11 to permit stop screw 10 to be screwed into contact with circular members 7*a* and/or 7*b* to prevent members 7*a* and 7*b* from rotating. More preferably, the middle section 17 should be positioned so that the series of metal semi-rigid coiled strings 18 of snares 6 are positioned to bear against interior surface 9 of the top wall 2. In a preferred embodiment the middle section 17 can be rotated to permit it to be sloped at a desired angle to cause strings 18 to exert the desired amount of pressure against interior surface 9 and then fixed in position by stop screw 10.

Although the present invention and its advantages have been described in detail, it should be understood that various changes, substitutions and alterations can be made herein without departing from the spirit and scope of the invention as defined by the appended claims. As would be obvious to a person of ordinary skill in the art, the various related features of the illustrated alternate preferred embodiments could be substituted for one another and still achieve the objectives of this invention. Moreover, the scope of the present application is not intended to be limited to the particular embodiments of the process, machine, manufacture, composition of matter, means, methods and steps described in the specification. As one of ordinary skill in the art will appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim:

1. A musical instrument played by striking the instrument with a person's foot comprising a. a body having a first surface area constructed to be struck by the person's foot and having a second surface area to which is attached a snare operatively bearing on the second surface area in a manner to be responsive to the first surface area being struck by the person's foot;

b. the body comprising a top wall having an exterior surface comprising the first surface area constructed to be struck by the person's foot, and an interior surface comprising the second surface area;

c. a side wall affixed to the top wall and constructed having a port connecting a cavity formed by the top wall, side wall and a bottom wall affixed to the side wall to an environmental area outside the body; and d. wherein leg members extend outward from the exterior surface of the bottom wall to support the body above a ground surface that the body is to be positioned for playing.

2. The musical instrument according to claim 1 wherein the bottom wall is constructed having a port connecting the cavity to an environmental area outside the body.

3. The musical instrument according to claim 1 wherein snares are affixed to bear against the second surface area located at a position on the interior surface below the first surface area.

4. The musical instrument according to claim 3 wherein the body is constructed to permit a person to stand on the first surface area and to play the instrument by striking the first surface area with the person's foot.

5. The musical instrument according to claim 1 wherein the snare comprises a series of metal, semi-rigid coiled strings.

6. The musical instrument according to claim 5 wherein the snare is fixed to an elongated member rotatable mounted in the cavity at the position to place the series of metal, semi-rigid coiled strings against and bear pressure on the interior surface area of the top wall whereby the snare will vibrate when the exterior surface of the top wall is struck by the person's foot.

* * * * *